United States Patent [19]

Lin

[11] Patent Number: 4,727,610

[45] Date of Patent: Mar. 1, 1988

[54] MULTI-PURPOSE STAPLER

[76] Inventor: Johnny C. H. Lin, 5F-8, No. 413, Lin Sen N. Road, Taipei, Taiwan

[21] Appl. No.: 895,100

[22] Filed: Aug. 11, 1986

[51] Int. Cl.[4] ..... B25F 1/00

[52] U.S. Cl. ..... 7/160; 227/76; 227/156

[58] Field of Search ..... 7/160, 170, 158; 227/76, 120, 156

[56] References Cited

U.S. PATENT DOCUMENTS

| | | | |
|---|---|---|---|
| 1,663,242 | 3/1928 | Crofoot | 227/156 |
| 3,596,820 | 8/1971 | Lou | 227/76 |
| 4,114,793 | 9/1978 | Hsu | 227/76 |
| 4,491,261 | 1/1985 | Mitsuhashi | 7/160 |

FOREIGN PATENT DOCUMENTS

| | | | |
|---|---|---|---|
| 725934 | 1/1966 | Canada | 7/160 |

*Primary Examiner*—Roscoe V. Parker

[57] ABSTRACT

A combination stapler, tape dispenser, hole puncher, pencil sharpener, paper clip holder, and storage compartment. A function plate with a block on top of it which can be slid back and forth lengthwise along the base of the present invention, so as to set which function can be used, i.e. the stapler or the hole puncher. The hole puncher has a scale so as to allow for accurate two hole punching. A waste flap below the pencil sharpener collects hole puncher blanks and pencil shavings. A punch arm support both supports the punch arm and acts as a hole puncher structure.

1 Claim, 5 Drawing Figures

MULTI-PURPOSE STAPLER

BACKGROUND OF THE INVENTION

This invention relates to a multi-purpose device for use in the home or at the office for normal administrative activites. Previously, many devices were needed to perform these various household and on-the-job activities. These devices included staplers, tape dispensers, hole punchers, pencil sharpeners, etc. However, it is often inconvenient to have so many different articles on a desk or table because of lack of space and because it often looks cluttered. In addition, it is very inconvenient to carry so many items from one place to another at the same tme because it is always easy to drop one of the items or even forget one of them. Moreover, it is inconvenient to try to find small things like paper clips, staples, tacks, etc. because they are usually scattered around in a desk drawer somewhere.

It is the purpose of this present invention, therefore, to mitigate and/or obviate the abovementioned drawbacks in the manner set forth in the detailed description of the preferred embodiment.

SUMMARY

A primary objective of this invention is to provide a multi-purpose deskmate article which can be used in place of a plurality of articles which were used around the office and on-the-job.

Another objective of this invention is to provide a multi-purpose deskmate which can store extra supplies of staples, paper clips, tacks, etc.

A further objective of this invention is to provide a multi-purpose deskmate which helps to organize and centralize the various articles commonly needed in the office and on-the-job.

Further objectives and advantages of the present invention will become apparent as the following description proceeds, and the features of novelty which characterize the invention are pointed out with particularlity of the claims annexed to and forming a part of this invention.

DETAILED DESCRIPTION OF THE PREFERRED EMBODIMENT

Figure 1:
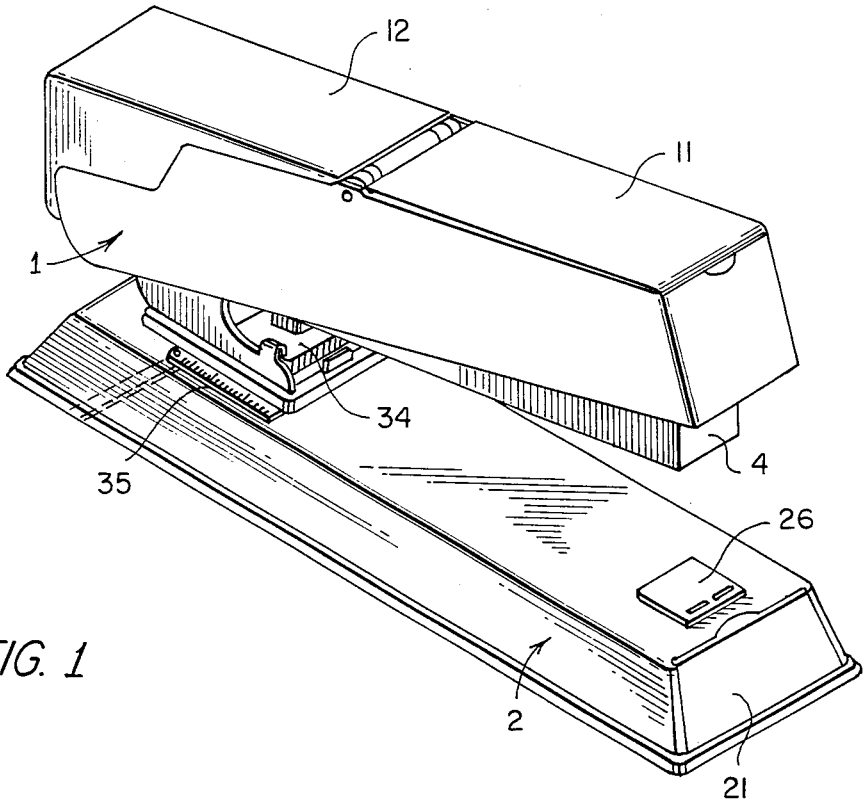
FIG. 1 is a perspective view of the present invention.

Referring to FIG. 1, it can be seen that the present invention has a punch arm 1 which comprises a staple punch 4, a taping compartment 12, and a two-way hinge 112. The present invention also has a base 2 which comprises a paper clip drawer 21, a staple blank 26, a scale 35, and a pencil sharpener (not shown). Secured to the base 2 and supporting the punch arm 1 is the punch arm support 3. The punch arm support 3 also serves as the outer structure of the hole puncher 31 (see FIG. 4).

Figure 2:
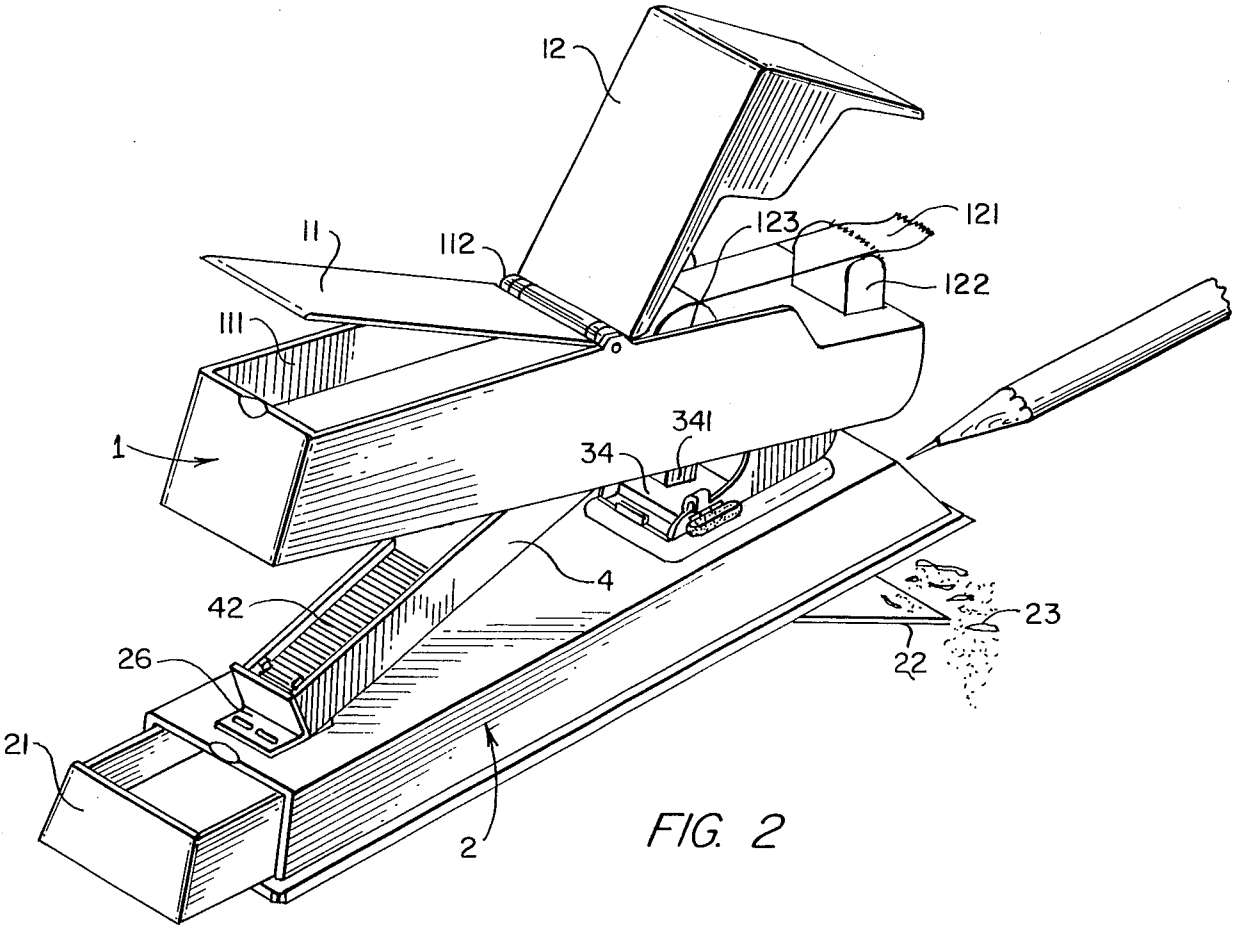
FIG. 2 is a view of the present invention with all openable parts opened so as to show the operations thereof more clearly.

FIG. 2 gives us an overall view of most of the uses of the present invention. It should be noted however, that in normal use only one part of the invention is used at one time. The storage flap 11 may be lifted so as to use the storage compartment 111. This compartment 111 may be used to store extra staples, tacks or any other small articles which might be convenient to put therein. However, since it is directly above the stapler, probably the most convenient usage for the storage compartment 111 is to store staples therein. On the opposite side of the punch arm 1 the tape compartment lid 12 can be seen. Under this lid is a tape dispenser which comprises a tape roller 123 and a tape cutter 122. On the lower portion of the punch arm 1 on the storage compartment end is a staple arm 4. The staple arm 4 pulls down from the punch arm 1 so as to load staples 42. Then the staple arm 4 is pushed back up to its normal position (as seen in FIG. 1) and used as a normal stapler.

Figure 5:
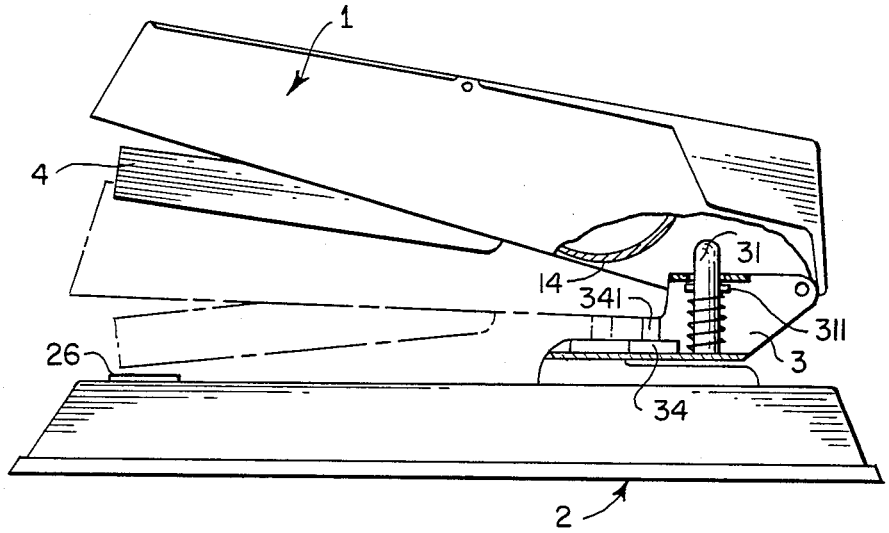
FIG. 5 is a partially cutaway view of the present invention showing how the function plate is used to select either the stapler function or the hole puncher function.

Referring to FIG. 5, it can be seen that the function plate 34 must be pulled out (i.e. toward the staple blank 26) before the stapler arm 4 can be used. This allows the stapler arm 4 to go down far enough to come into contact with the staple blank 26, thereby closing the staple. This is the position shown in dotted lines in FIG. 5. If it is desired to use the hole puncher 31, then the function plate 34 must be placed in the position closest to the hole puncher 31 end of the present invention. In both of the above cases, the user simply presses down on the punch arm 1 to accomplish the desired task.

Figure 3:
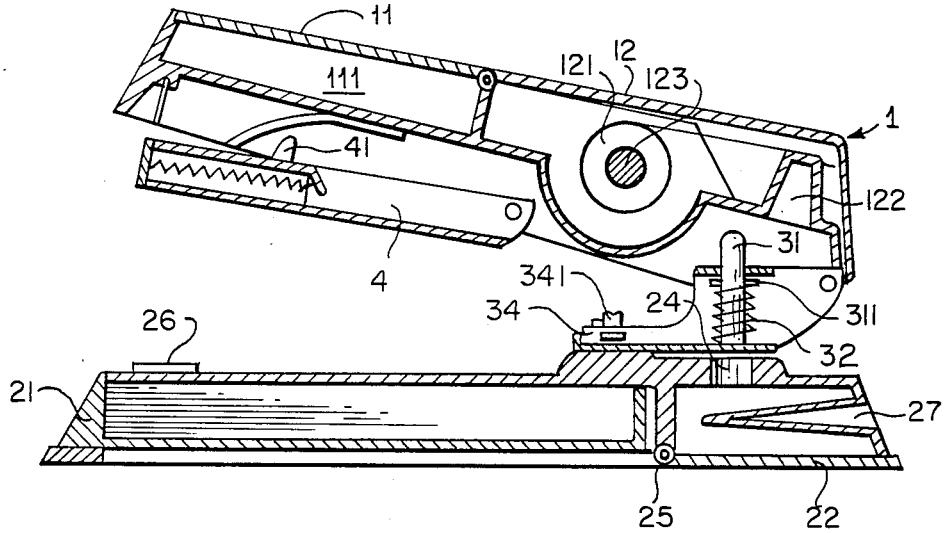
FIG. 3 is a cross-sectional view of the present invention.

Referring to FIG. 3, the inside of the tape compartment 12, which is on the punch arm 1, can be seen. A tape roller 123 is provided on the inside of this compartment 12. The tape compartment 123 also has a tape cutter 122.

As seen in FIG. 2, the base 2 has a paper clip drawer 21 on the staple blank end of the present invention. Of course, since the paper clip drawer 21 is relatively large, other articles (besides paper clips) could be put into it also. On the opposite end of the base is a built in pencil sharpener 27 which protrudes into an open cavity, so that the pencil shavings 23 will have a place to be stored until they are emptied by opening the waste flap 22 on the bottom of the hole puncher end of the base 2. A closer view of the pencil sharpener 27 and the waste flap 22 can be seen in FIG. 4.

Figure 4:
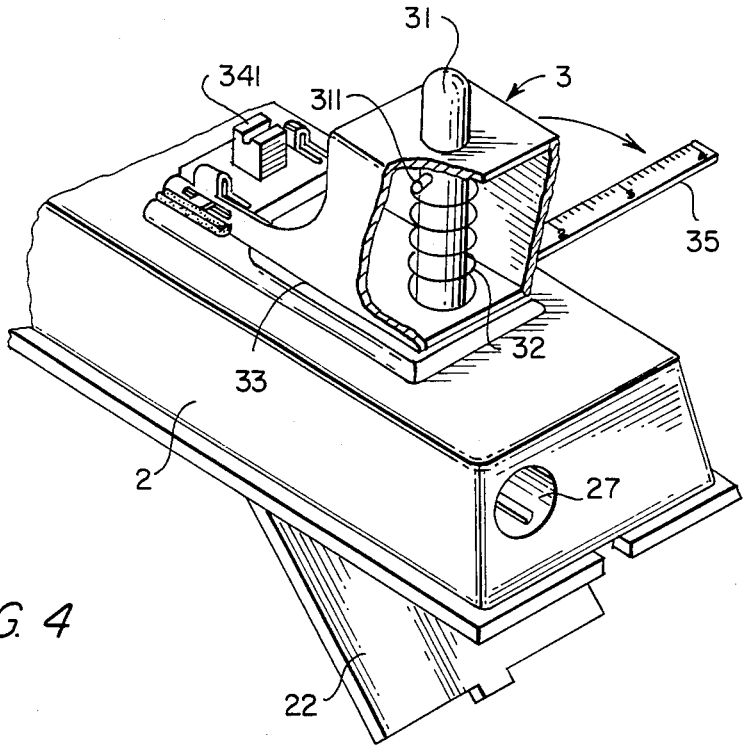
FIG. 4 is a view of the pencil sharpener end of the base of the present invention, also showing a cutaway view of the punch arm support of the present invention.

Also seen in FIG. 4 is a cutaway view of the punch arm support 3. As shown, the slideable scale 35 can be extended perpendicularly from the base 2 so that the single hole puncher 31 of the present invention can be used to punch two holes at one time. This is accomplished by simply folding the paper lengthwise and then inserting it, folded end first, with the top edge of the paper against the inside of the paper slot 33, until the folded end of the paper is perpendicular to and touching the 4 cm mark on the slideable scale 35. This is because most double hole punches are 8 cm apart from each other. Of course, different lengths of seperation between the punches can be easily calculated by simply dividing the desired seperation length by 2 and inserting the relevant paper to this new length as indicated by the slideable scale 35. Referring now to FIG. 3 again, it can be seen that the punch arm support 3 not only supports the staple arm 4, but also is the structure which mounts and stabilizes the hole puncher 31. The hole puncher 31 is spring-loaded by spring 32, which is retained by dowel 311 (see FIG. 4). After inserting a paper into the paper slot 33, the waste paper falls through the punch slot 24 into the cavity which holds the pencil shavings.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A multi-purpose deskmate having: a punch arm comprising a staple arm, a storage compartment, a storage flap covering said storage compartment, a tape compartment with a tape roller and a tape cutter; a hole puncher with a paper slot and a slideable scale for measuring the width between slots; a base comprising a pencil sharpener which deposits pencil shavings into an open compartment, a paper clip drawer, and a staple blank; and being further characterized in that:

a punch arm support connects the base and the punch arm together on the pencil sharpener end of said multi-purpose deskmate, said punch arm support also houses a function plate having a function block which determines whether the staple arm or the hole puncher is to be used, said paper clip drawer is on the end of said base opposite said pencil sharpener, a staple blank is on the paper clip drawer end of the base, and said hole puncher is mounted and stabilized by said punch arm support.

* * * * *